US010919332B2

(12) United States Patent
Feygelman et al.

(10) Patent No.: US 10,919,332 B2
(45) Date of Patent: Feb. 16, 2021

(54) CLEANING OF A SURFACE IN A PRINTING DEVICE

(71) Applicant: HP INDIGO B.V., Amstelveen (NL)

(72) Inventors: Alex Feygelman, Petach-Tiqwa (IL); Mordechai Arenson, Ness Ziona (IL); Oran Levintant, Rehovot (IL); Roy Maman, Ness Ziona (IL); Kai-Kong Iu, San Diego, CA (US); Shunit Petachia Halely, Netanya (IL); Shai Rahamim, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 257 days.

(21) Appl. No.: 15/573,916

(22) PCT Filed: Jul. 29, 2015

(86) PCT No.: PCT/US2015/042733
§ 371 (c)(1),
(2) Date: Nov. 14, 2017

(87) PCT Pub. No.: WO2017/019071
PCT Pub. Date: Feb. 2, 2017

(65) Prior Publication Data
US 2018/0354289 A1 Dec. 13, 2018

(51) Int. Cl.
*B41N 3/00* (2006.01)
*B08B 3/02* (2006.01)
(Continued)

(52) U.S. Cl.
CPC ..... *B41N 3/006* (2013.01); *B08B 1/006* (2013.01); *B08B 1/008* (2013.01); *B08B 3/02* (2013.01); *B08B 5/02* (2013.01); *B41F 19/001* (2013.01); *B41F 35/00* (2013.01); *B08B 2220/01* (2013.01); *B08B 2230/01* (2013.01);
(Continued)

(58) Field of Classification Search
CPC ..... B08B 1/006; B08B 1/008; B08B 2220/01; B08B 2230/01; B08B 3/02; B08B 5/02; B41F 19/001; B41F 35/00; B41N 3/006; B41P 2235/21; B41P 2235/24; B41P 2235/26
See application file for complete search history.

(56) References Cited

U.S. PATENT DOCUMENTS 4,190,966 A 3/1980 Sando et al.
4,984,028 A 1/1991 Tonomoto
(Continued)

FOREIGN PATENT DOCUMENTS

CN 1137976 12/1996
CN 1160638 10/1997
(Continued)

OTHER PUBLICATIONS

Machine translation of DE 4412821A1 (Year: 1995).*
(Continued)

*Primary Examiner* — Douglas Lee
(74) *Attorney, Agent, or Firm* — Michael A Dryja

(57) ABSTRACT

The present disclosure relates to cleaning a surface in a printing device, wherein a steam guiding member directs a steam flow towards the surface; wherein the steam flow interacts with a substance on said surface to clean a portion of the surface.

16 Claims, 4 Drawing Sheets

(51) Int. Cl.

| | |
|---|---|
| ***B08B 1/00*** | (2006.01) |
| ***B08B 5/02*** | (2006.01) |
| ***B41F 35/00*** | (2006.01) |
| ***B41F 19/00*** | (2006.01) |

(52) U.S. Cl.
CPC ..... *B41P 2235/21* (2013.01); *B41P 2235/24* (2013.01); *B41P 2235/26* (2013.01)

(56) References Cited

U.S. PATENT DOCUMENTS

| | | | | |
|---|---|---|---|---|
| 5,531,188 | A | 7/1996 | Tomasulo | |
| 5,802,976 | A | 9/1998 | Friedrichs | |
| 5,940,673 | A | 8/1999 | Han | |
| 6,050,392 | A * | 4/2000 | Straub | B65G 45/22 198/495 |
| 2003/0167948 | A1 | 9/2003 | Weitz | |
| 2004/0024337 | A1 | 2/2004 | Tseng et al. | |
| 2005/0132913 | A1 | 6/2005 | Gottling et al. | |
| 2007/0175348 | A1 * | 8/2007 | Petri | B41F 35/00 101/424 |
| 2010/0077958 | A1 | 4/2010 | Fitch | |
| 2013/0228195 | A1 * | 9/2013 | Kim | B08B 3/022 134/6 |
| 2014/0008030 | A1 | 1/2014 | Porco | |

FOREIGN PATENT DOCUMENTS

| | | | | |
|---|---|---|---|---|
| CN | 1209584 | | 3/1999 | |
| CN | 1787918 | | 6/2006 | |
| CN | 101495248 | | 7/2009 | |
| CN | 103286087 | | 9/2013 | |
| CN | 103286087 | A * | 9/2013 | |
| CN | 107580528 | | 1/2018 | |
| DE | 4412821 | | 10/1995 | |
| DE | 4412821 | A1 * | 10/1995 | B41F 35/00 |
| DE | 10135658 | | 2/2003 | |
| DE | 102004028552 | | 1/2006 | |
| DE | 102012006000 | A1 * | 9/2013 | B08B 3/026 |
| EP | 0328369 | | 8/1989 | |
| EP | 0857817 | | 8/1998 | |
| EP | 0942230 | | 9/1999 | |
| GB | 2516107 | | 1/2015 | |
| JP | 07092843 | A * | 4/1995 | |
| JP | 2013123666 | | 6/2013 | |
| WO | WO-8802697 | | 4/1988 | |
| WO | WO-2008096950 | | 8/2008 | |
| WO | WO-2010065270 | | 6/2010 | |

OTHER PUBLICATIONS

Machine translation of DE 102012006000A1 (Year: 2013).*
Machine translation of JP07092843A (Year: 1995).*
Unknown, "Steam Vapor Cleaning for Hard Surfaces", Naturally Bubbly (website), May 12, 2015, 8 pages.
Anthony Cotton, "Cleaning Your Printer Drum Roller", Ink Supply Guy (website), Aug. 15, 2012, 2 pages.

* cited by examiner

CLEANING OF A SURFACE IN A PRINTING DEVICE

Printing technologies can improve the adhesion of ink to a media by priming the media just prior to printing, in particular where the media can otherwise not be effectively used for printing. In this way, the customer is able to use a wider selection of media types.

An In-Line-Primer (ILP) is a device that can be used during the printing process to prime the media just prior to printing. The priming can be performed by depositing a thin layer of primer on a roller, such as for example an Ethylene Propylene Diene terpolyMer or Monomer (EPDM) rubber roller. The EPDM roller wetted with the primer can then transfer the primer to the media.

Examples of this disclosure are described with reference to the drawings which are provided for illustrative purposes, in which.

Figure 1:
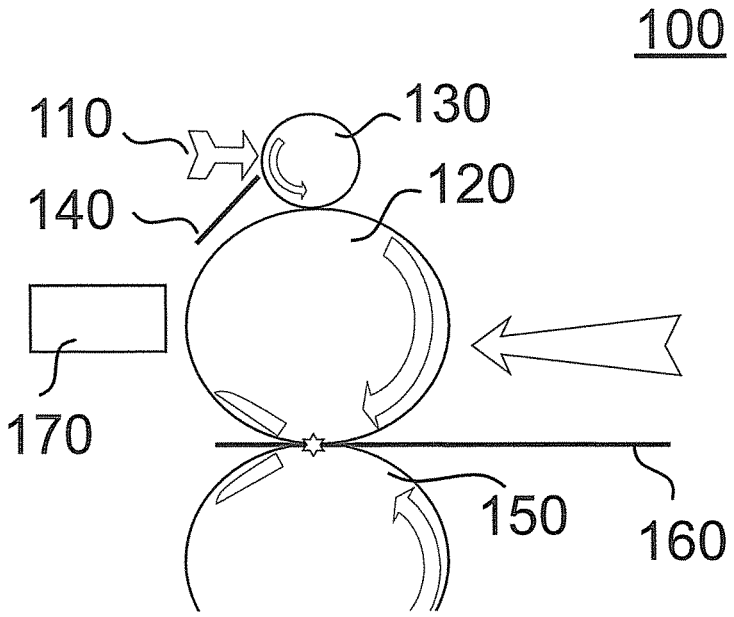
FIG. 1 shows an example of an In-Line-Primer (ILP) system.

In-Line Priming (ILP) improves the adhesion of a printing fluid such as, for example, ink to a media and allows the customer to use a wider selection of media types in a printing process. FIG. 1 shows an example of an In-Line Priming (ILP) system 100 wherein a thin layer of primer 110 is deposited on an ethylene propylene diene terpolymer rubber (EPDM) roller 120 by a metering roller 130 and a wiping blade 140. The wetted EPDM roller 120 is then pushed against a second roller 150 to transfer the primer to a media 160 which is arranged between the wetted EPDM roller 120 and the second roller 150. In an example, the media 160 can include a cut sheet or a continuous web media, for example paper sheets. Priming of cut sheet media may involve challenges which are not necessarily present in priming of continuous web media. For example, a possible difference is that in web priming the EPDM roller 120 can be constantly wetted while in cut sheet handling there are unwetted areas which result from the variable sheet size and discrete nature of the cut sheets.

Figure 2:
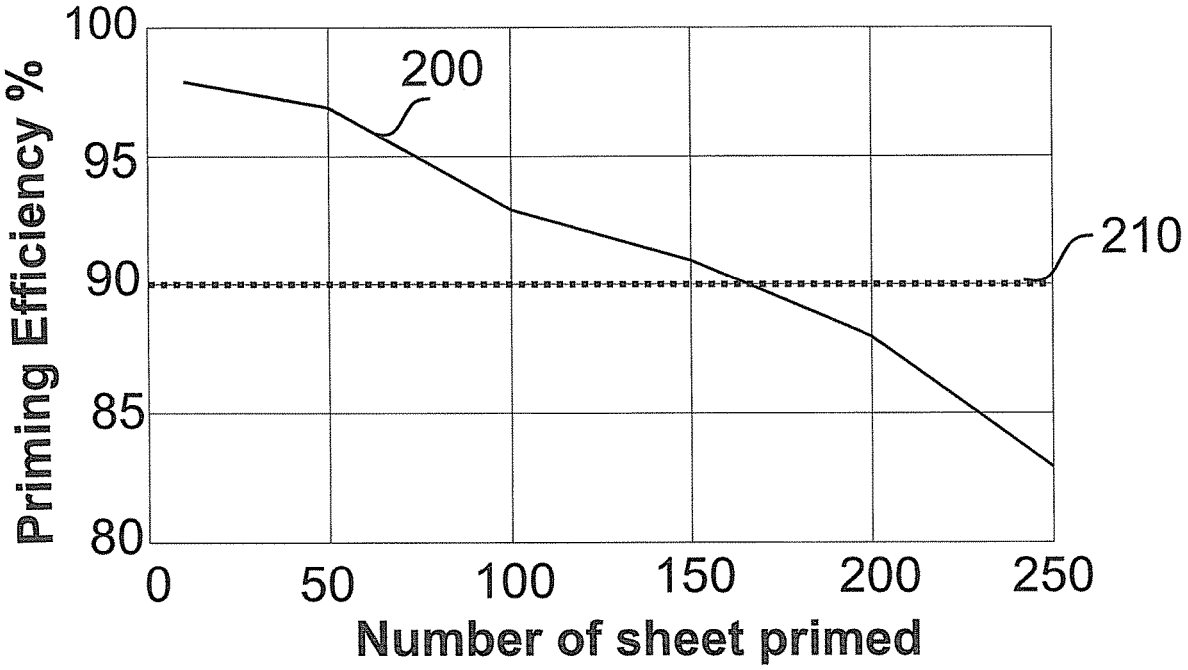
FIG. 2 shows a chart illustrating how the priming efficiency decreases over a number of media sheets primed.

The primer 110 is a tacky material that if left to dry on the EPDM roller can change the surface properties of the roller 120 and degrade its functionality. As such, ILP processes may include or be associated with a process for cleaning substances, such as residual primer and/or paper dust from the primed rubber roller surface. FIG. 2 illustrates how the priming efficiency 200 can decrease below acceptance level 210 of the EPDM roller 120 as a function of the number of sheets primed in the interval between cleanings. The reduction of the EPDM roller 120 priming efficiency can be further aggravated by the presence of paper dust carried by the media 160 that interacts with the residual primer, resulting in a tacky composite of paper dust and primer that can clog the pores or open cells of the components of ILP system 100, such as the metering roller 130 and the EPDM roller 120. To avoid possible downtime, implementations of the present disclosure can include cleaning the EPDM roller 120 in a non-damaging manner during the short intervals available during the priming process. In this respect, the ability of implementations of the present disclosure to clean during printing can open the way for improved printer utilization.

According to one example, this disclosure provides an apparatus for cleaning a surface in a printing device; see, for example, the cleaning apparatus 170 in FIG. 1. The surface can, for example, be a flat surface in the printing device or the surface of a roller 120 used to transfer a primer to a print media 160 in an In-Line-Primer 100. In an example, the roller can comprise an EPDM rubber roller 120, and the print media 160 can, for example, include paper. In order to clean the surface, a cleaning member can be arranged to contact the surface. The cleaning member can, for example, include a cloth, a cloth belt, a sponge, a wiper, to name a few examples. A steam guiding member can be provided to direct a steam flow towards the surface, and at least one barrier unit can be provided to confine the steam flow to a portion of the surface. The steam flow can include or consist of water steam, with or without additives. Alternatively, other cleaning fluids can be used to interact with the cleaning member to clean the roller surface. A stream of cleaning fluid can be provided that is of any of the phases: a gas phase, a liquid phase or both.

Figure 3:
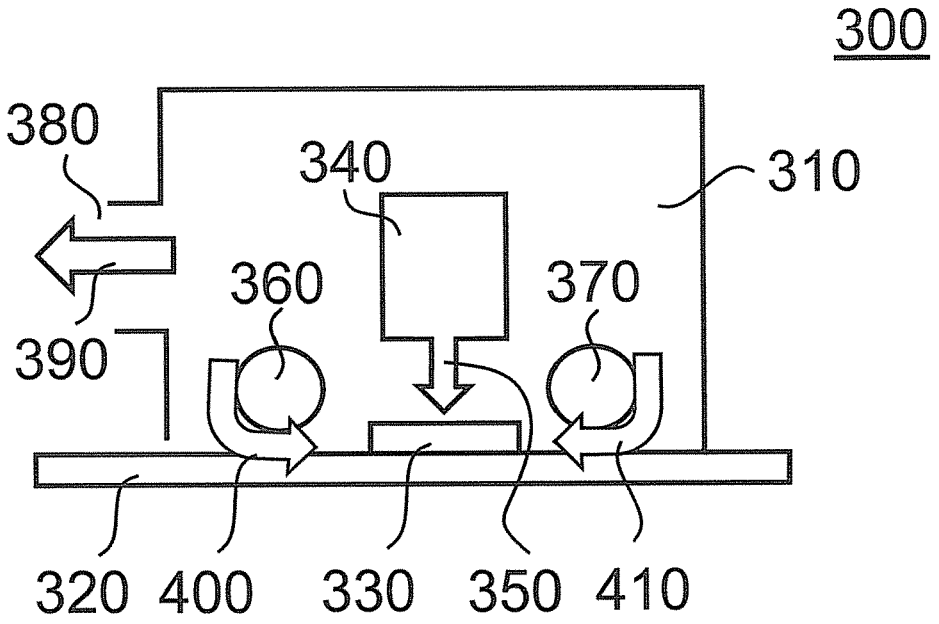
FIG. 3 shows an example of an apparatus including a cleaning member for cleaning a surface in a printing device.

A more specific example of the apparatus for cleaning a surface in a printing device 300 is schematically illustrated in FIG. 3. Here, the apparatus can include a chamber 310 having an open side adapted to face a surface 320. In this example, the surface can represent a roller surface 320. A cleaning cloth 330 can be arranged as a cleaning member inside the chamber 310 to contact the roller surface 320 in a contact area. A manifold 340 can be arranged as a steam guiding member at least partly inside the chamber 310 and can be adapted to guide a steam flow 350 towards the roller surface 320. According to the example of FIG. 3, two barrier units 360, 370 can be arranged inside the chamber 310 and adapted to prevent the steam flow 350 from exiting the chamber 310 at the roller surface 320. An outlet 380 can be formed into a wall of said chamber 310 to exhaust the steam flow 350, 390 from the chamber 310. In an example, air suction is applied at the outlet end 380 of the chamber 310 to evacuate a mixture of water droplets, steam, air and primer residue, e.g. through an exhaust filter. In other words, portion of the steam flow 350 can condense when it comes to contact with the roller surface 320 creating a mixture of fluid and vapor. The interaction between the primer with steam and water can provide an efficient penetration effect in which primer residue on the surface is removed and a new layer of primer residue is ready to be cleaned. The steam flow can be directed to the "bare" roller surface 320 or to the cleaning member 330 which covers a defined portion of the roller surface 320. In the latter case, the steam flow penetrates and saturates the cleaning member 330 which is used to wipe the roller surface 320. In the first case, the steam flow first directly interacts with the primer to solve primer residue, and then the primer residue is removed by wiping the roller surface 320 using the cleaning member 330. In a further situation primer residue and/or other substances can be cleaned of the roller surface 320 by the steam flow without the use of an additional cleaning member. This can be the case e.g. for a primer not having cross-linker additives.

In the example shown in FIG. 3, the cleaning approach is based on directing a steam flow 350 to the roller surface 320 being cleaned. Steam has high enthalpy which is effective in dissolving, for example, water based primer solutions. The steam flow may consist of or include water steam, with or without additives. Pure water steam is a chemically neutral material and works well in combination with water-based primers. Due to this high enthalpy, small amounts of steam are effective in cleaning relatively large areas of primer residue. Moreover, steam does not leave problematic residue, is environmentally-friendly, and can be generated, guided and evacuated using efficient means. Thus, based on the architecture of the example illustrated in FIG. 3, primer residue can be cleaned from the roller using steam. In various implementations, the steam can be injected into chamber 310 or generated inside of chamber 310. The chamber 310 can have the form of a box, wherein an open side of the box faces the roller surface 320 to be cleaned of primer residue and/or paper dust.

The steam flow, be it water steam or steam made from or including other substances, is sufficiently warm to heat the primer beyond its glass temperature to melt and solve primer residue. In one example, the glass temperature of the primer can be in the order of 75° C.

In an example, the steam can be generated in a boiler, and then directed to the steam manifold 340 shown in FIG. 3, wherein the boiler can be arranged inside or outside the chamber 310. Other ways of generating steam are feasible. The manifold 340 can guide the steam flow towards the roller surface 320, for example by saturating the cleaning cloth 330 arranged to contact the roller surface 320. In an example, the cleaning cloth 330 includes a micro-fiber cleaning cloth 330 which can be kept saturated to transfer part of the steam to the roller surface 320. In this way, the micro-fiber cleaning cloth 330 can, for example, be used for cleaning primer residue on the roller surface 320. The micro-fiber cleaning cloth 330 can be selected for durability and softness, and arranged to make soft contact with the roller surface 330 to avoid damage to the surface 320. Such implementations are well adapted to cleaning roller surfaces 320 including soft EPDM rubber, for example.

In one example, a micro-fiber cloth or cleaning belt is made of or includes fibers from the PPS family. Polyphenylene Sulfide (PPS) is an organic semi-crystalline polymer with highly stable chemical bonds. PPS has good chemical and temperature resistance and can withstand hot, humid and corrosive conditions. PPS also is dimensionally stable and has good electric properties. In one example a PPS-based cloth having an air permeability of about 200 $L/m^2$-sec and capable of withstanding a working temperature up to 190 deg C. can be used.

Figure 4:
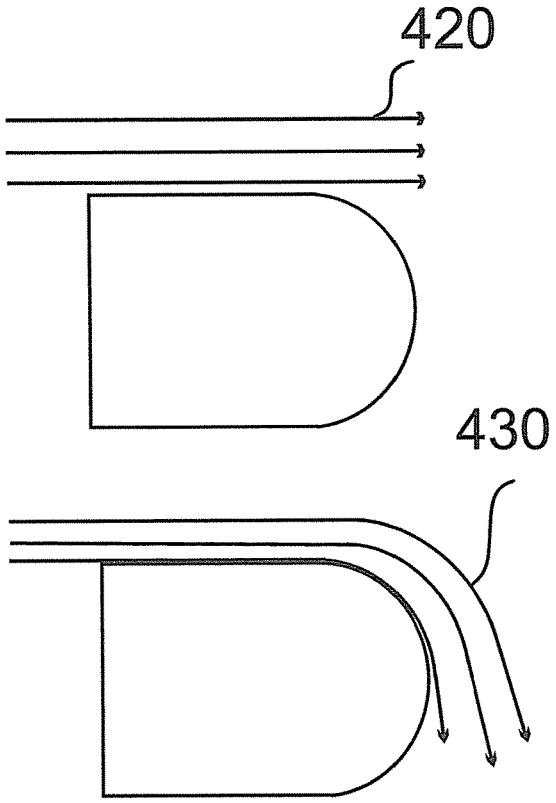
FIG. 4 shows an aerodynamic effect referred to as the Coanda effect used in the example of FIG. 3.

In the example shown in FIG. 3, the two barrier units 360, 370 can be arranged inside the chamber 310 and can be adapted to prevent the steam flow 350 from exiting the chamber 310 at the roller surface 320. For this purpose, the first barrier unit 360 can be adapted to provide a first air curtain 400, and the second barrier unit 370 can be adapted to provide a second air curtain 410, wherein the first and second air curtains 400, 410 effectively create a sealed chamber 310 and thus prevent any leakage of the steam flow 350 at the roller surface 320. The first and second barrier units 360, 370 can each have a curved surface and may comprise a cylindrical or semi-cylindrical or similarly shaped guide member which provides the curved surface for directing the air curtain. The guide member can have a longitudinal dimension extending perpendicularly to the flow direction of the air curtain. Examples of cross-sectional shapes of the guide member of the barrier units 360, 370 are shown in FIGS. 3 and 4.

In a further example, the first and second air curtains 400, 410 are achieved by an aerodynamic effect referred to as Coanda. Thus, at least one of the barrier units 360, 370 can be adapted to guide the air by having the air follow a surface of the barrier unit 360, 370 using the Coanda effect. As illustrated in FIG. 4, due to the Coanda effect, the air near the roller surface 320 does not flow radially 420, instead it follows the contour of the surface of the barrier units 360, 370 and thus steers the flow tangentially 430. This arrangement ensures that the chamber 310 is sealed at the roller surface 320 and thus prevents steam flow 350 from escaping from the chamber 310 at the roller surface 320.

In an example, the air curtains 400, 410 can have at least one of the two additional functions: cooling and drying. The cooling provided by the air flow of the air curtains 400, 410 can avoid or prevent the hot steam flow 350 from causing thermal damage to the roller surface 320, in particular to an EPDM rubber roller surface. Further, the air flow provided by the air curtains 400, 410 can, for example, be used to dry and thus avoid uncontrolled dilution of the primer with steam residue or condensation.

Figure 5:
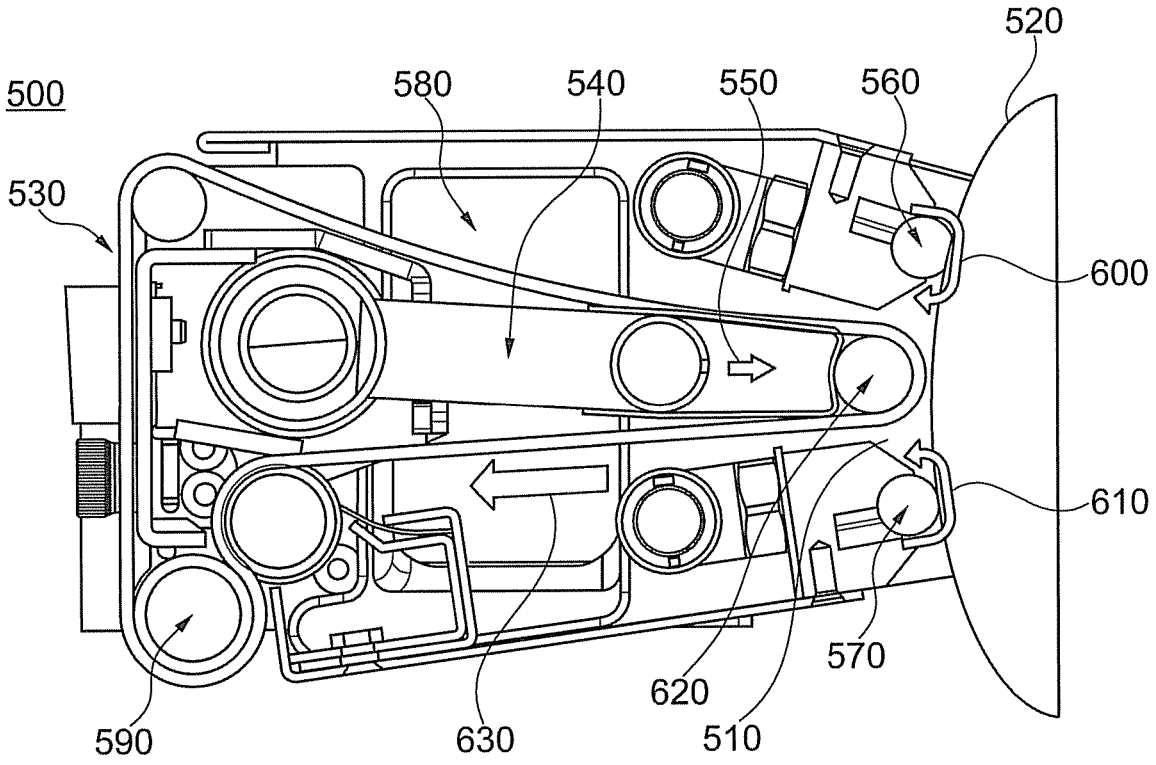
FIG. 5 shows an example of an apparatus including a cleaning cloth belt for cleaning a roller surface in a printing device.

In the example shown in FIG. 3, the cleaning cloth 330 is arranged to contact an area of the roller surface 320 which is located between said barrier units 360, 370. In this way, the barrier units 360, 370 can guide an air stream along the surface of the barrier units 369, 370 and keep the steam flow 350 away from the chamber 310 walls and confined to the contact area of the cleaning cloth 330, to improve the sealing effect at the roller surface 320. The barrier units 360, 370 hence effectively create air curtains FIG. 5 shows a further example of an apparatus for cleaning a surface in a printing device 500, wherein the apparatus 500 includes a chamber 510 having an open side adapted to face the surface 520. In this example, the surface is a roller surface 520. A cleaning cloth belt 530 can be arranged as a cleaning member inside the chamber 510 to contact the roller surface 520 in a contact area. In this example, the cleaning cloth belt 530 moves in the direction indicated by the arrow 630. A cleaning cloth belt drive mechanism 590 comprises an arrangement configured and disposed to move the cleaning cloth belt 530 relative to the roller surface 520. A manifold 540 can be arranged as a steam guiding member at least partly inside the chamber 510 and can be adapted to guide a steam flow 550 towards the roller surface 520. According to the example of FIG. 5, two barrier units 560, 570 can be arranged inside the chamber 510 and prevent the steam flow 550 from exiting the chamber 510 at the roller surface 520. More specifically, and as shown in FIG. 5, the two barrier units 560, 570 can be adapted to guide air along the surface of the cleaning units 560, 570 to create air curtains confining the respective contact area of the cleaning cloth belt 530, to prevent the steam flow 550 from exiting the chamber 510 at the roller surface 520. In order to further enhance the sealing effect, the contact area of the cleaning cloth belt 530 can be arranged between the barrier units 560, 570. An outlet 580 can be formed into a wall of said chamber 510 to exhaust the steam flow 550 from the chamber 510. In an example, air suction is applied at the outlet 580 end of the chamber 510 to evacuate a mixture of water droplets, steam, air and primer residue, e.g. through an exhaust filter, as discussed in detail above.

In the example shown in FIG. 5, the cleaning approach is based on directing a steam flow 550 to the roller surface 520 being cleaned. Steam has high enthalpy which is effective in dissolving, for example, water based primer solutions. Due to this high enthalpy, small amounts of steam are effective in cleaning relatively large areas of primer residue. Moreover, steam does not leave problematic residue, is environmentally-friendly, and can be generated, guided and evacuated using efficient means.

In a further example, the steam can be generated in a boiler, and then directed to the steam manifold 540 shown in FIG. 5, where the boiler can be arranged inside or outside the chamber 510. Other ways of generating steam are feasible. The manifold 540 can be adapted to guide the steam flow 550 towards the roller surface 520, for example by saturating the cleaning cloth belt 530 arranged to contact the roller surface 520. For this purpose, the manifold 540 can, for example, include a nozzle for guiding the steam flow 550 towards the roller surface 520 with greater precision. Moreover, the cleaning cloth belt drive mechanism 590 can include a stretch roller 620 arranged to stretch the cleaning cloth belt 530 and bring it in contact with the roller surface 520 when the steam flow 550 exiting the manifold reacts on the stretch roller 620. In this way, the steam pressure can be adjusted to change the contact force between the cleaning cloth belt 530 and the roller surface 520, and thus allows for adjustment of the cleaning effect.

In an example, the cleaning cloth belt 530 includes a micro-fiber cleaning cloth belt 530 which can, for example, be kept saturated to transfer part of the steam to the roller surface 520. In this way, the micro-fiber cleaning cloth belt 530 can, for example, be used for cleaning primer residue on the roller surface 520. The micro-fiber cleaning cloth belt 530 is particularly useful because of its durability, and also because the micro-fiber cleaning cloth belt 530 can be selected and arranged to make soft contact with the roller surface 530 to avoid damage. This can be particularly useful when the roller surface 520 includes soft EPDM rubber. In a further example, the micro-fiber cleaning cloth belt 530 is an endless belt. In this way, a more compact and/or simplified structure of the apparatus can be provided. The lifespan of the micro-fiber cleaning cloth belt 530 can be extended by using a slow belt movement which brings different sections of the belt to use. For example, the cleaning cloth belt drive mechanism 590 can be adapted to move the cleaning cloth belt 530 relative to the roller surface 520 at a linear velocity, for example at approximately 0.01 m/s.

A relatively slow belt movement is sufficient to provide a "fresh" section of the cleaning cloth for each wiping operation. Slow belt movement also makes sure that the section of the cleaning cloth which is steam saturated can properly interact with the primer on the roller surface 520 to melt and solve the primer. The wiping action as such can be enhanced by a relative movement between the roller surface 520 and the cleaning cloth belt 530 when the roller to be cleaned rotates relative to the cleaning cloth belt 530. An example of a rotation speed can be in the range of 2 m/s.

As illustrated in FIG. 5, the two barrier units 560, 570 can be arranged inside the chamber 510 and can be adapted to prevent the steam flow 550 from exiting the chamber 510 at the roller surface 520. For this purpose, the first barrier unit 560 can be adapted to provide a first air curtain 600, and the second barrier unit 570 can be adapted to provide a second air curtain 610, wherein the first and second air curtains 600, 610 effectively create a sealed chamber 510 and thus prevent leakage of the steam flow 550 at the roller surface 520.

As discussed above, the first and second air curtains 600, 610 can be achieved by using the Coanda effect. Thus, at least one of the barrier units 560, 570 can be adapted to guide the air by having the air follow a surface of the barrier unit 560, 570 using the Coanda effect. This arrangement ensures that the chamber 510 is sealed at the roller surface 520 to prevent steam flow 550 from escaping from the chamber 510 at the roller surface 520. In a further example, the Coanda effect can also be applied to effectively guide the steam flow 550 along the surface of the cleaning cloth belt 530 away from roller surface 520, for example toward the outlet 580. Moreover, as explained above, the air curtains 600, 610 can be adapted to provide additional cooling and/or drying functions.

Figure 6:
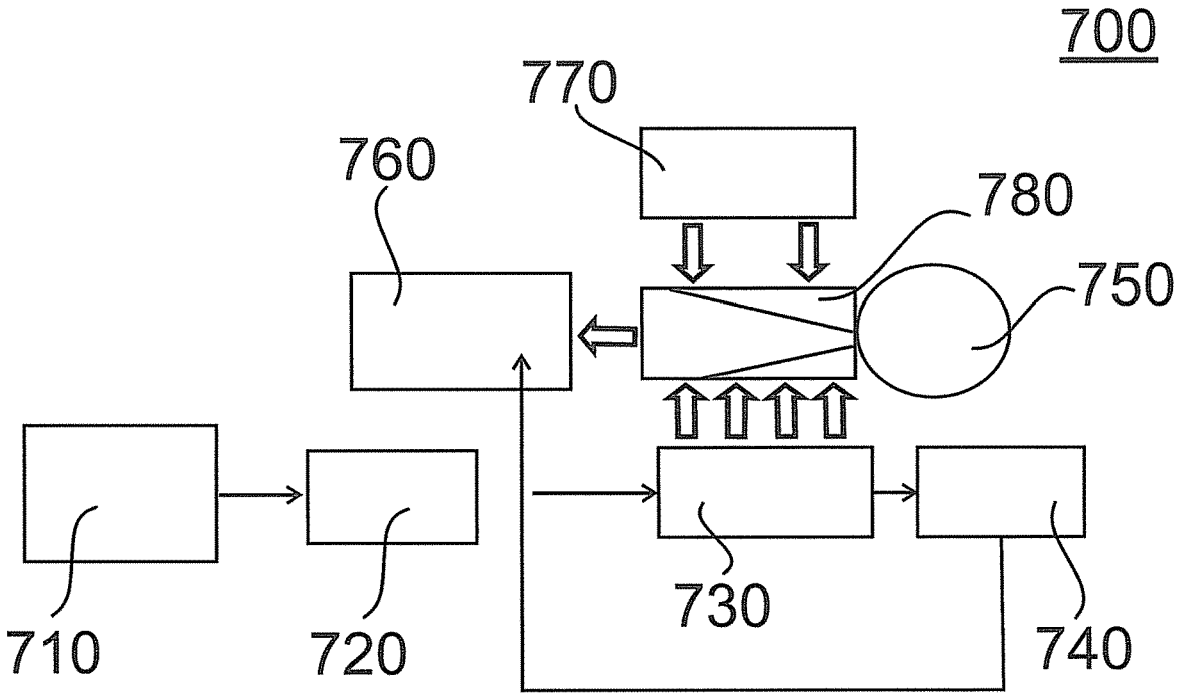
FIG. 6 shows an example of an apparatus including a purge valve for cleaning a surface in a printing device.

The examples of apparatuses for cleaning a surface in a printing device, as shown in FIGS. 3 and 5, can be provided with a purge value to shorten the reaction time of the respective cleaning apparatus. In other words, when the purge valve is open, the steam flow can be guided directly to the exhaust without delay. When the purge valve is closed, the steam can be forced to flow through the manifold to, for example, the EPDM roller. FIG. 6 illustrates an example of such a cleaning apparatus 700 where steam is generated in a steam generator 710 and then guided to flow through a main steam valve 720 to the respective manifold 730. In this example, a purge valve 740 is arranged at the exit of the manifold 730, which can, for example, include a nozzle. Thus, a purge valve 740 can be arranged at the exit or nozzle end of the manifold and can be operated to guide the steam flow through the manifold 730 towards the roller surface 750, or to guide the steam flow directly to an outlet 760 to exhaust the steam flow from the respective chamber. If the purge valve 740 guides the steam flow through the manifold 730 towards the roller surface 750, barrier units 770 and steam guiding elements 780 guide the steam to clean the roller surface 750 and then direct the steam flow towards the outlet 760. If the purge valve 740 guides the steam flow directly to the outlet 760, the steam can take a low resistance path and goes straight, e.g. via an air filter, to the outlet 760, for example without entering the chamber. Thus, a standby state can be achieved by operating the purge valve 740 where the steam flow is low, which allows keeping the manifold hot for improved performance, and also prevents condensation of the steam due to cooling.

An example of a method of cleaning a surface in a printing device comprises: arranging a cleaning member to contact an area of the surface, guiding a steam flow towards the surface, and confining the steam flow to a portion of the surface using at least one barrier unit. As discussed in detail above, the surface can, for example, be a flat surface in the printing device or the surface of a roller used to transfer a primer to a print media in an In-Line-Primer. In an example, the roller can comprise an ethylene propylene diene terpolymer rubber roller, and the print media can, for example, include paper. In order to clean the surface, a cleaning member can be arranged to contact the surface, wherein the cleaning member can, for example, include a cloth, a cloth belt, a sponge, a wiper, to name a few examples.

Figure 7:
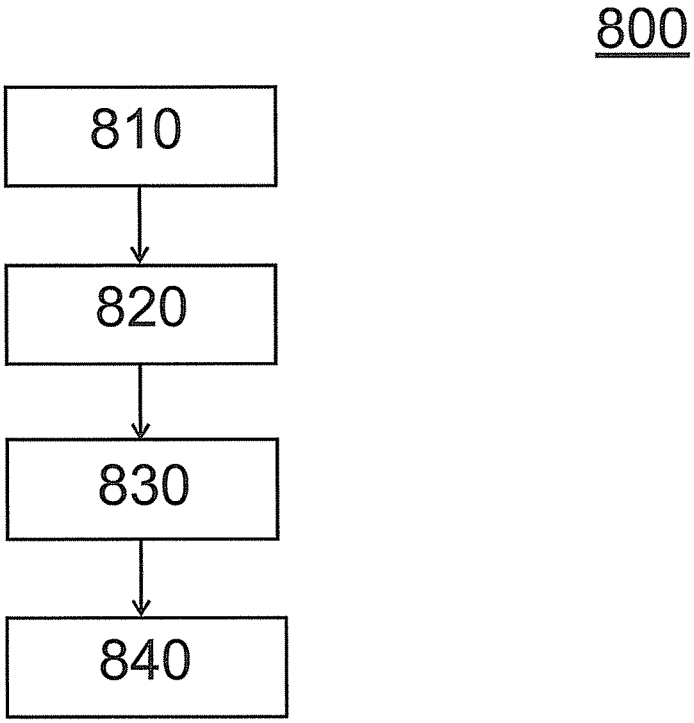
FIG. 7 shows a flow diagram of an example of a method for cleaning a surface in a printing device.

FIG. 7 shows a more specific example of a method 800 for cleaning a surface in a printing device, wherein an open side of a chamber faces a roller surface.

In block 810 of the method, a cleaning cloth or a cleaning cloth belt is arranged as a cleaning member to contact an area of the roller surface, wherein the cleaning cloth or cleaning cloth belt is included inside the chamber. As discussed above, the surface can, for example, be a flat surface of the printing device or the surface of a roller used to transfer a primer to a print media in an In-Line-Primer, for example in an in-line process, and in particular an EPDM rubber roller surface.

In block 820, a steam flow is guided through a steam guiding member, such as for example a manifold, towards the roller surface, wherein the manifold is at least partly arranged inside the chamber. In this way, the steam flow is guided to contact with the roller surface to heat primer residue on the roller surface, for example beyond their glass temperature. In a further example, where the roller surface is the surface of an EPDM rubber roller, the steam is guided through a manifold towards the roller surface to heat primer residue on the roller surface beyond a temperature of around 75° C. In this way, the steam can be guided to heat the primer beyond its glass temperature and make it a fluid, which can be more easily removed from the EPDM surface as a mixture of water droplet and air, e.g. by suction used to evacuate the mixture during printing. In other words, and as discussed in detail above, the respective steam cleaning mechanism can be based on melting the primer on the roller surface and washing the melted primer of the surface, e.g. with condensed vapor.

In block 830, air is guided along the roller surface towards said contact area of the cleaning cloth or cleaning cloth belt, to prevent the steam flow from exiting the chamber at the roller surface. In this example, the contact area of the cleaning cloth or cleaning cloth belt is arranged between at least two barrier units guiding the air. For example, the barrier units can be operated to provide air curtains, wherein the air curtains effectively seal the chamber by preventing leakage of the steam flow at the roller surface. As explained above, by positioning the contact area of the cleaning cloth or cleaning cloth belt between the at least two barrier units guiding the air, the sealing effect of the barrier units can be improved. Moreover, the barrier units can be adapted to use an aerodynamic Coanda effect to guide the air along the roller surface towards the contact area of the cleaning cloth or cleaning cloth belt, wherein the Coanda effect results in the air following a surface of at least one of said barrier units.

In block 840, the steam flow is exhausted from the chamber through an outlet formed in a wall of the chamber. In a further example, a purge valve of the manifold is operated to guide the steam flow through the manifold towards the roller surface, or to guide the steam flow directly to said outlet to exhaust the steam from the chamber. In this way, the reaction time of the cleaning apparatus can be shortened. Moreover, as explained above, by guiding the steam to flow directly to the outlet, the steam can take a low resistance path and go straight, e.g. via an air filter, to the outlet, for example without entering the chamber. In other words, the purge value allows a standby state where the steam flow is low, which can be useful for keeping the manifold hot for improved performance, and for preventing condensation due to cooling.

Thus, the present disclosure provides a cleaning design which can, for example, utilize both steam and micro-fiber cloth to clean surfaces in printing devices. The design can further incorporate air curtains which take advantage of the aerodynamic Coanda effect to create an enclosed chamber without mechanical contact. It follows that the cleaning design can be effectively used in-line during printing and thus allows higher throughput than off-line solutions. An efficient and compact cleaning solution can be provided, which can be used in-line during priming and printing, for example to reduce down time. This cleaning design can be adapted to various situations, in particular where cleaning of a rotating roller is required, for example where the roller corresponds to a rotating cylinder.

Moreover, as the steam used for cleaning can have high energy per unit mass, low and cost effective amounts of steam are sufficient for cleaning the surface rapidly and/or thoroughly. The small mass rates further simplify the evacuation of the steam, for example by allowing the implementation of compact and/or simple air suction systems.

What is claimed is:

1. An apparatus for cleaning an advancing surface in a printing device, comprising:

a continuously recirculating cleaning belt having a perimeter;

a cleaning press roller to bring the cleaning belt in contact with the surface;

a cleaning drive roller to continuously recirculate the cleaning belt; and a steam guiding member interiorly located within the perimeter of the cleaning belt to direct a steam flow towards the cleaning press roller at an opposite side of the cleaning press roller to a side at which the cleaning press roller is to bring the cleaning belt in contact with the surface;

wherein the steam flow interacts with a substance on said surface to clean a portion of the surface.

2. The apparatus of claim 1 further comprising a steam generator wherein the steam is water steam.

3. The apparatus of claim 1 wherein the cleaning belt comprises a cloth belt or a micro-fiber cloth belt.

4. The apparatus according to claim 1, wherein the portion of the surface is a first portion, the apparatus further comprising:

a chamber having a wall incident to a second portion of the surface; and a barrier unit inset and separate from the wall of the chamber and incident to a third portion of the surface, the barrier unit to confine the steam flow to the first portion of the surface, wherein the surface comprises a fourth portion between the second and third portions at which the surface is exposed between an end of the wall at which the wall is closest to the surface and the barrier unit along an outwardly direction from the barrier unit towards the wall and parallel to the surface.

5. The apparatus of claim 4 wherein the barrier unit guides air to provide an air curtain confining the steam flow to the first portion of the surface.

6. The apparatus according to claim 5, wherein the barrier unit guides the air using an aerodynamic Coanda effect.

7. The apparatus according to claim 4, wherein the chamber has an open side facing the surface, and wherein the barrier unit is arranged inside the chamber to prevent the steam flow from exiting the chamber at the open side facing the surface.

8. The apparatus according to claim 1, further comprising:

a transfer roller including the surface, the transfer roller to transfer a primer to a print media in an In-Line-Primer.

9. The apparatus of claim 1, wherein the cleaning drive roller is configured to continuously recirculate the cleaning belt at a speed less than a speed at which the surface is advanced in the printing device.

10. The apparatus of claim 9, wherein the surface is a roller surface advancing at a rotational speed, and wherein the speed at which the cleaning drive roller is configured to continuously recirculate the cleaning belt is a linear speed less than the rotational speed at which the roller surface is advanced in the printing device.

11. The apparatus of claim 1, wherein the cleaning press roller is to stretch the cleaning belt where the cleaning belt is brought in contact with the surface.

12. An apparatus for cleaning a roller surface in a printing device, the apparatus comprising:

a chamber having walls defining an open side facing the roller surface;

a continuously recirculating cleaning belt having a perimeter;

a cleaning press roller arranged inside the chamber to bring the cleaning belt in contact with the surface at a contact area;

a cleaning drive roller to continuously recirculate the cleaning belt;

a manifold interiorly located within the perimeter of the cleaning belt to guide a steam flow towards the cleaning press roller at an opposite side of the cleaning press roller to a side at which the cleaning press roller is to bring the cleaning belt in contact with the roller surface;

a plurality of barrier units inset and separate from the walls of the chamber to confine the steam flow and prevent the steam flow from exiting the chamber at the roller surface, the contact area positioned between the barrier units, a portion of the roller surface exposed between ends of the walls at which the walls are closest to the roller surface and the barrier units along an outwardly direction from the barrier units towards the walls and parallel to the roller surface; and an outlet formed in the chamber to exhaust the steam flow from the chamber.

13. The apparatus according to claim 12, further comprising a purge valve operable to guide the steam flow through the manifold towards the roller surface, or to guide the steam flow directly to the outlet to exhaust the steam flow from the chamber.

14. A method of cleaning a surface in a printing device, comprising:

continuously recirculating a cleaning belt via a cleaning drive roller, the cleaning belt having a perimeter;

bringing the cleaning belt in contact with the surface via a cleaning press roller;

guiding a steam flow towards the cleaning press roller at an opposite side of the cleaning press roller to a side at which the cleaning press roller is to bring the cleaning belt in contact with the surface, via a steam guiding member interiorly located within the perimeter of the cleaning belt;

wherein the steam flow interacts with a substance on the surface to clean a portion of the surface.

15. The method according to claim 14, wherein the steam flow is guided to the surface to heat primer residue on the surface beyond a glass temperature associated with the primer residue.

16. The method according to claim 14, wherein the steam flow is confined to a portion of the surface by directing an air stream, via a barrier unit, to provide an air curtain.

* * * * *